US010801263B2

(12) United States Patent
Dangrow et al.

(10) Patent No.: US 10,801,263 B2
(45) Date of Patent: Oct. 13, 2020

(54) LADDER WITH TOP FOR HOLDING AN IMPACT DRIVER AND METHOD

(71) Applicants: Joseph Dangrow, Mercer, PA (US); Troy Johnson, Jamestown, PA (US); Derek Bibler, Sharpsville, PA (US); Christopher Ruppen, New Brighton, PA (US)

(72) Inventors: Joseph Dangrow, Mercer, PA (US); Troy Johnson, Jamestown, PA (US); Derek Bibler, Sharpsville, PA (US); Christopher Ruppen, New Brighton, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 15/903,904

(22) Filed: Feb. 23, 2018

(65) Prior Publication Data

US 2019/0264505 A1 Aug. 29, 2019

(51) Int. Cl.

| | |
|---|---|
| ***E06C 7/14*** | (2006.01) |
| ***E06C 1/18*** | (2006.01) |
| ***E06C 7/48*** | (2006.01) |
| ***E06C 1/20*** | (2006.01) |

(52) U.S. Cl.

CPC ..... *E06C 7/14* (2013.01); *E06C 1/18* (2013.01); *E06C 1/20* (2013.01); *E06C 7/48* (2013.01)

(58) Field of Classification Search

CPC .... E06C 7/14; E06C 7/48; B25H 3/06; B25H 3/04

USPC ..... 220/349, 372, 379, 373

See application file for complete search history.

(56) References Cited

U.S. PATENT DOCUMENTS

| | | | | |
|---|---|---|---|---|
| 6,997,282 | B1 * | 2/2006 | Sharp | E06C 1/39 182/129 |
| 7,032,711 | B1 * | 4/2006 | Katz | B25H 3/06 182/129 |
| 7,063,187 | B1 * | 6/2006 | Lavigne | E06C 1/39 182/129 |
| D531,322 | S * | 10/2006 | Patton | D25/68 |
| 7,128,187 | B2 * | 10/2006 | Simpson | E06C 1/387 182/129 |
| 7,159,694 | B2 * | 1/2007 | Gibson | E06C 1/393 182/129 |
| 7,264,084 | B1 * | 9/2007 | Switzer | E06C 7/14 182/129 |
| D597,685 | S * | 8/2009 | Gibson | E06C 7/14 D25/68 |
| D600,820 | S * | 9/2009 | Gomez Lopez | E06C 7/14 D25/68 |
| 9,534,443 | B1 * | 1/2017 | Bogart | E06C 1/39 |
| 2002/0017430 | A1 * | 2/2002 | Rosko | E06C 1/387 182/129 |

(Continued)

*Primary Examiner* — Katherine W Mitchell
*Assistant Examiner* — Shiref M Mekhaeil
(74) *Attorney, Agent, or Firm* — Ansel M. Schwartz

(57) ABSTRACT

A ladder having a plane having a periphery. The plane having a body opening to receive a body of an impact driver and a trigger recess extending from the body opening to receive a trigger of the impact driver. The body opening conforming to a shape of the body and the trigger recess conforming to the shape of the trigger. The body opening and the trigger recess holding the impact driver when the impact driver is placed on the top. A ladder top. A method for using an impact driver with a ladder.

6 Claims, 12 Drawing Sheets

(56) References Cited

U.S. PATENT DOCUMENTS

2003/0089630 A1* 5/2003 Cooper ..... B25H 3/006 206/349
2004/0238278 A1* 12/2004 Gibson ..... E04G 1/28 182/129
2006/0214384 A1* 9/2006 Gwin ..... A47L 13/51 280/79.5
2006/0219586 A1* 10/2006 Phillips ..... A47J 47/16 206/373
2007/0181367 A1* 8/2007 Astor ..... E06C 7/14 182/129
2007/0181761 A1* 8/2007 Astor ..... E06C 7/14 248/238
2007/0193829 A1* 8/2007 Astor ..... E06C 1/18 182/129
2007/0284191 A1* 12/2007 Astor ..... E06C 7/14 182/129
2007/0284192 A1* 12/2007 Meyers ..... A47C 12/00 182/129
2009/0078504 A1* 3/2009 Astor ..... E06C 1/39 182/129
2009/0229918 A1* 9/2009 Moss ..... E06C 1/18 182/129
2009/0250365 A1* 10/2009 Goto ..... B25H 3/006 206/349
2009/0283361 A1* 11/2009 Gibson ..... E06C 7/14 182/129
2013/0128560 A1* 5/2013 Werner ..... B25H 3/02 362/154
2013/0146394 A1* 6/2013 Astor ..... E06C 7/14 182/129
2014/0332316 A1* 11/2014 Tiber ..... E06C 7/14 182/129
2014/0353191 A1* 12/2014 DeCicco ..... B25H 3/006 206/373
2015/0090533 A1* 4/2015 Moss ..... E06C 1/16 182/180.1
2016/0192989 A1* 7/2016 Aman ..... A61B 17/1622 606/53
2017/0259424 A1* 9/2017 Vetter ..... B25H 3/006
2018/0187488 A1* 7/2018 Mora ..... E06C 7/482
2018/0187489 A1* 7/2018 Parker ..... E06C 1/18
2019/0226279 A1* 7/2019 Beggs ..... E06C 1/18

* cited by examiner

LADDER WITH TOP FOR HOLDING AN IMPACT DRIVER AND METHOD

FIELD OF THE INVENTION

The present invention is related to a ladder top which holds an impact driver. (As used herein, references to the "present invention" or "invention" relate to exemplary embodiments and not necessarily to every embodiment encompassed by the appended claims.) More specifically, the present invention is related to a ladder top which holds an impact driver in a body opening and a trigger recess of the ladder top.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

When using a ladder, workmen on the ladder need safe and convenient access to tools and equipment they are using to perform the work they are doing from the ladder. Simply because they are standing on the ladder several feet off the ground they also want the tools and equipment to be stably secured to the ladder so the tools and equipment will not fall off the ladder and be damaged, or cause damage to the area around the ladder for injury to workmen around the ladder. Impact drivers and drills are typically larger and heavier and more cumbersome than other tools, such as pliers or screwdrivers, that are commonly used by workmen standing on a ladder. Because of their size and weight in configuration, their position on the ladder could also affect the center of gravity on the ladder, possibly causing the ladder to be more likely to tip over depending on where the impact driver or drill is positioned on the ladder when not being used. Due to the shape of impact drivers, it would be desirable to provide a safe, secure and convenient location on the ladder top to hold an impact driver for the workmen.

BRIEF SUMMARY OF THE INVENTION

The present invention pertains to a ladder. The ladder comprises a ladder top having a plane having a front and a rear. The plane having a periphery. The plane having a body opening to receive a body of an impact driver and a trigger recess extending from the body opening to receive a trigger of the impact driver. The body opening conforming to a shape of the body and the trigger recess conforming to the shape of the trigger. The body opening and the trigger recess holding the impact driver when the impact driver is placed on the top. The plane has a top surface and a bottom surface. The plane has a front side flange, a rear side flange, a right side flange, and a left side flange, all of which extend down from the perimeter. The ladder comprises a front section having a first front rail and a second front rail in parallel and spaced relation with the first front rail. The first front rail and the second front rail extending from the top and attached to the right side flange and the left side flange, respectively. There may be rungs attached to the first front rail and the second front rail. The ladder comprises a rear section having a first rear rail and a second rear rail in parallel in spaced relation with the first rear rail. The first rear rail and the second rear rail extending from the top and attached to the right side flange and the left side flange, respectively. The ladder top and the front and rear sections form the ladder, otherwise called a stepladder.

The present invention pertains to a method for using an impact driver with a ladder. The method comprises the steps of positioning the ladder in a desired position. There is the step of placing the impact driver into a top of the ladder. The top having a plane having a front and a rear. The plane having a periphery. The plane having a body opening to receive a body of an impact driver and a trigger recess extending from the body opening to receive a trigger of the impact driver. The body opening conforming to a shape of the body and the trigger recess conforming to the shape of the trigger. The body opening and the trigger recess holding the impact driver when the impact driver is placed on the top. The plane has a top surface and a bottom surface. The plane has a front side flange, a rear side flange, a right side flange, and a left side flange, all of which extend down from the perimeter.

The present invention pertains to a top for a ladder. The top comprises a plane having a front and a rear. The plane having a periphery. The plane having a body opening to receive a body of an impact driver and a trigger recess extending from the body opening to receive a trigger of the impact driver. The body opening conforming to a shape of the body and the trigger recess conforming to the shape of the trigger. The body opening and the trigger recess holding the impact driver when the impact driver is placed on the top. The plane has a top surface and a bottom surface. The plane has a front side flange, a rear side flange, a right side flange, and a left side flange, all of which extend down from the perimeter.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
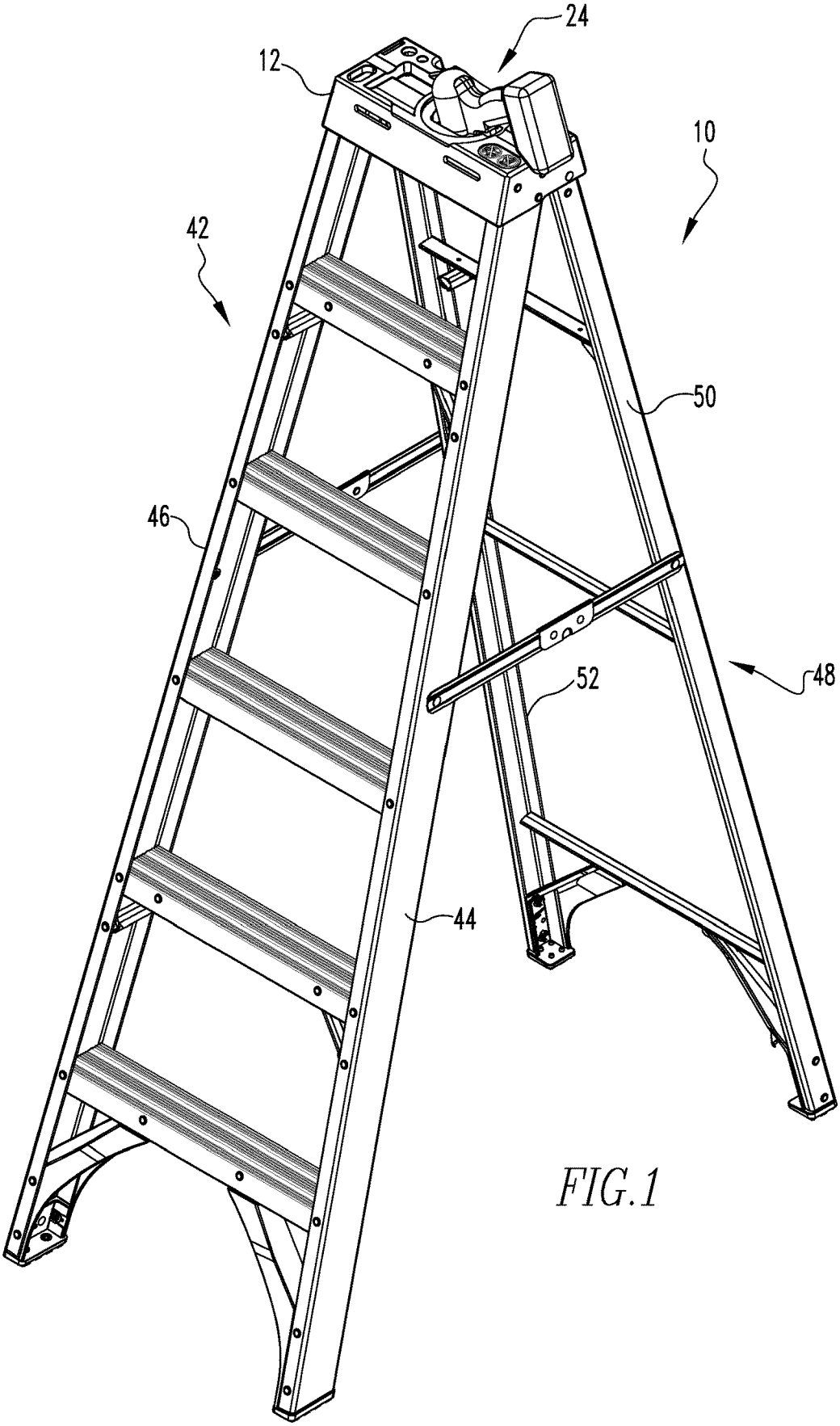
FIG. 1 is a perspective view of a ladder holding an impact driver in the ladder top.
Figure 2:
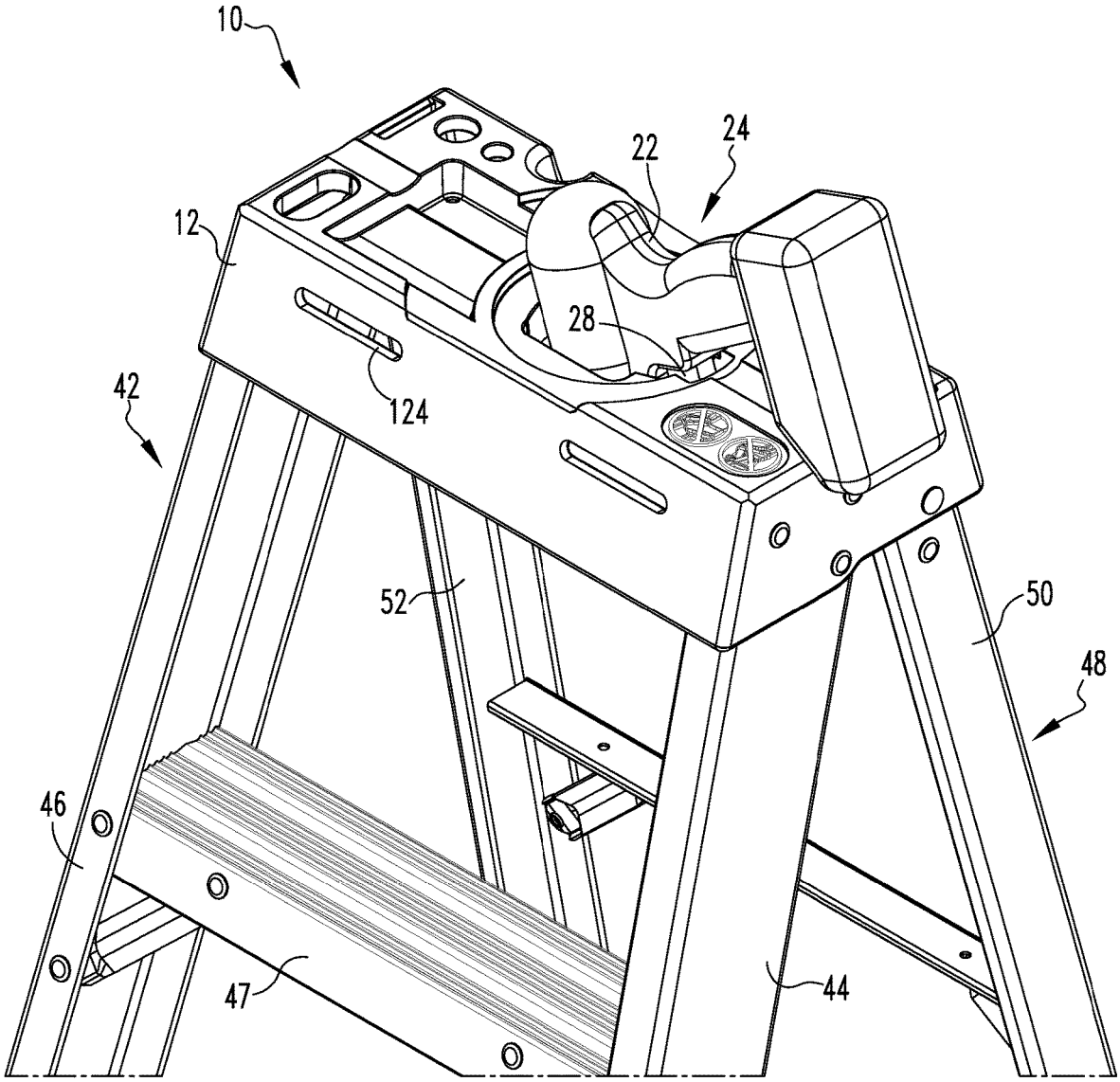
FIG. 2 is a perspective view of the top of the ladder holding an impact driver.
Figure 3:
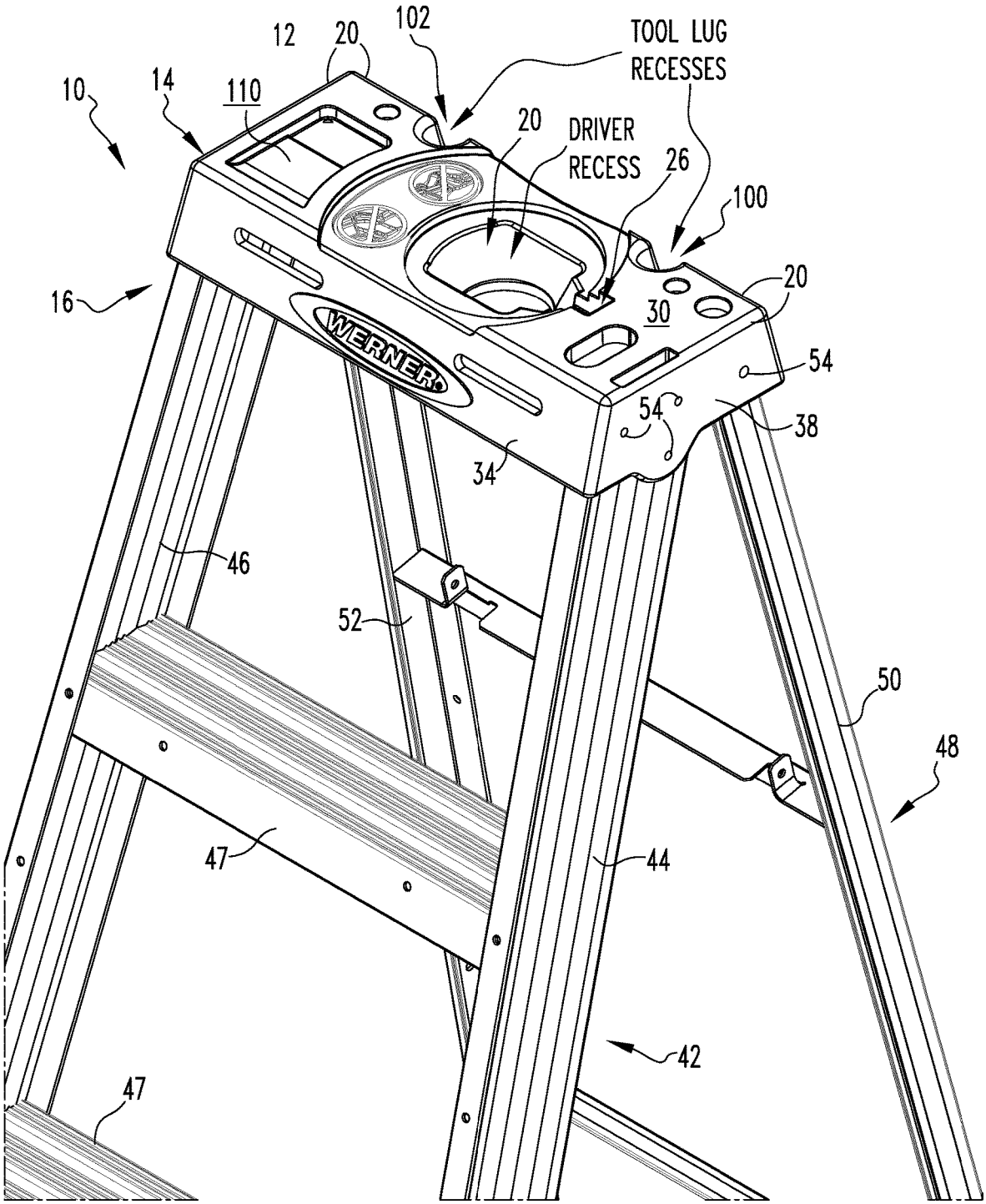
FIG. 3 is a perspective view of the top of the ladder.
Figure 4:
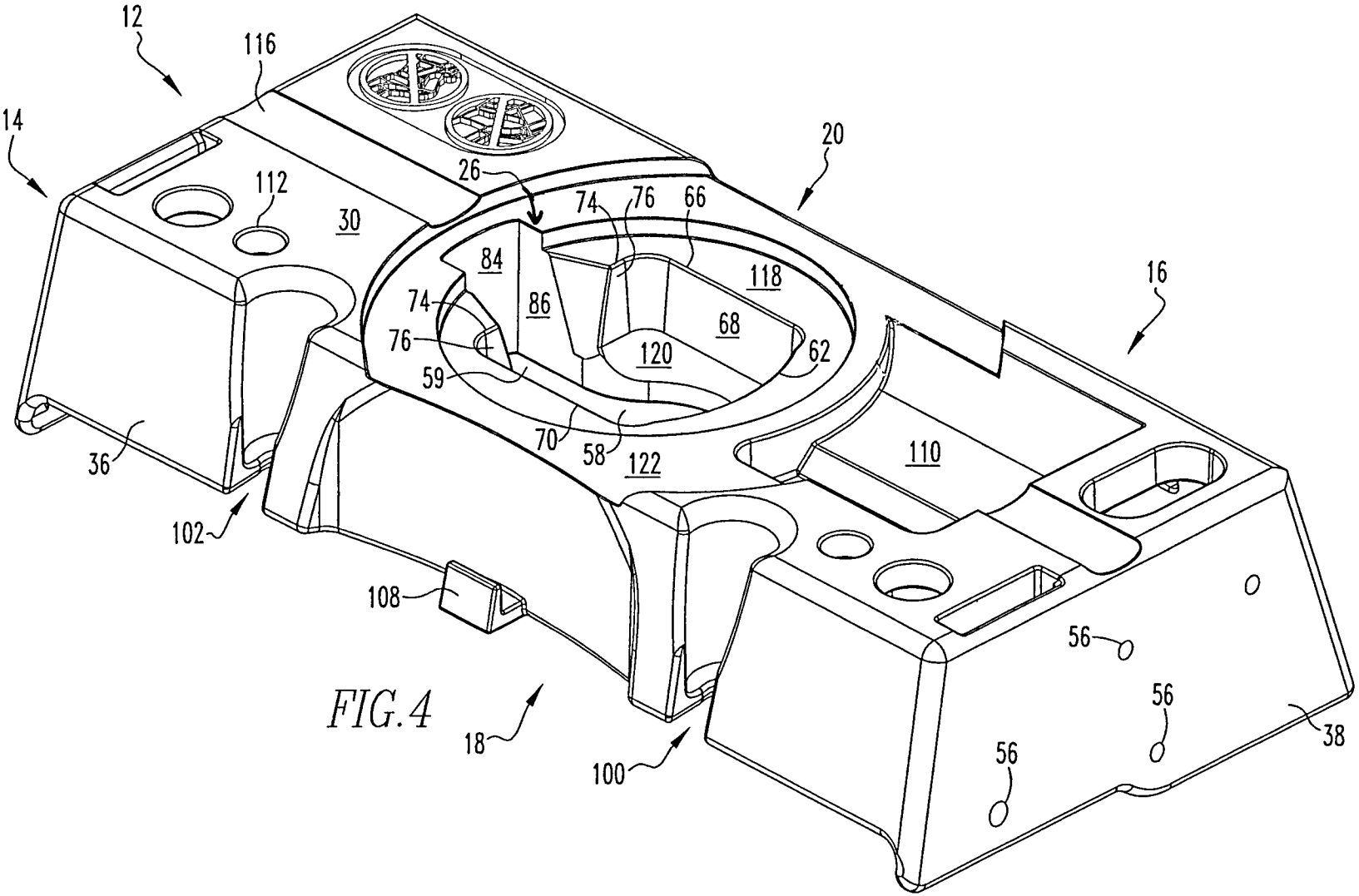
FIG. 4 is a rear front view of the top of the ladder.
Figure 5:
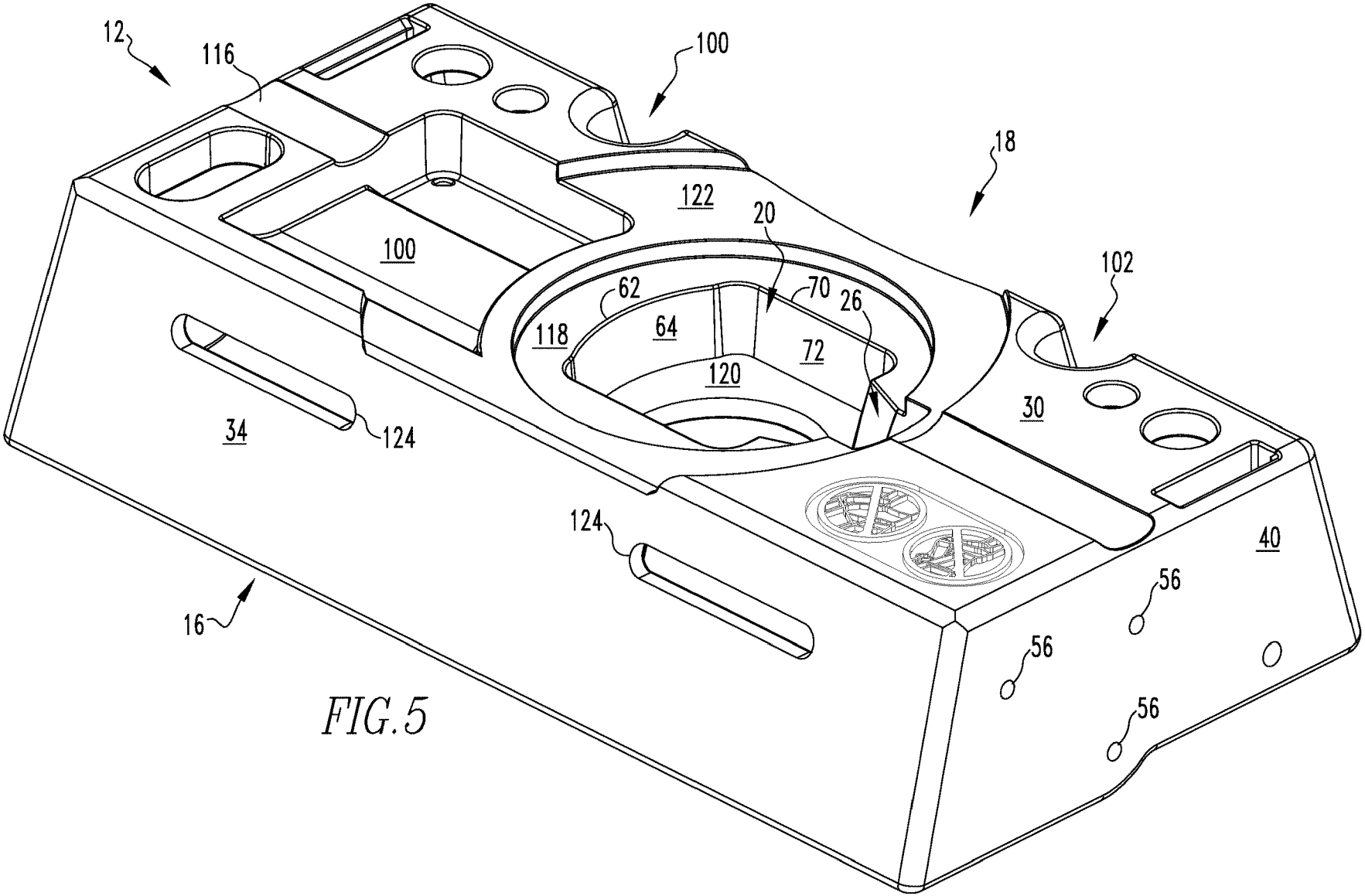
FIG. 5 is a front view of the top of the ladder.
Figure 6:
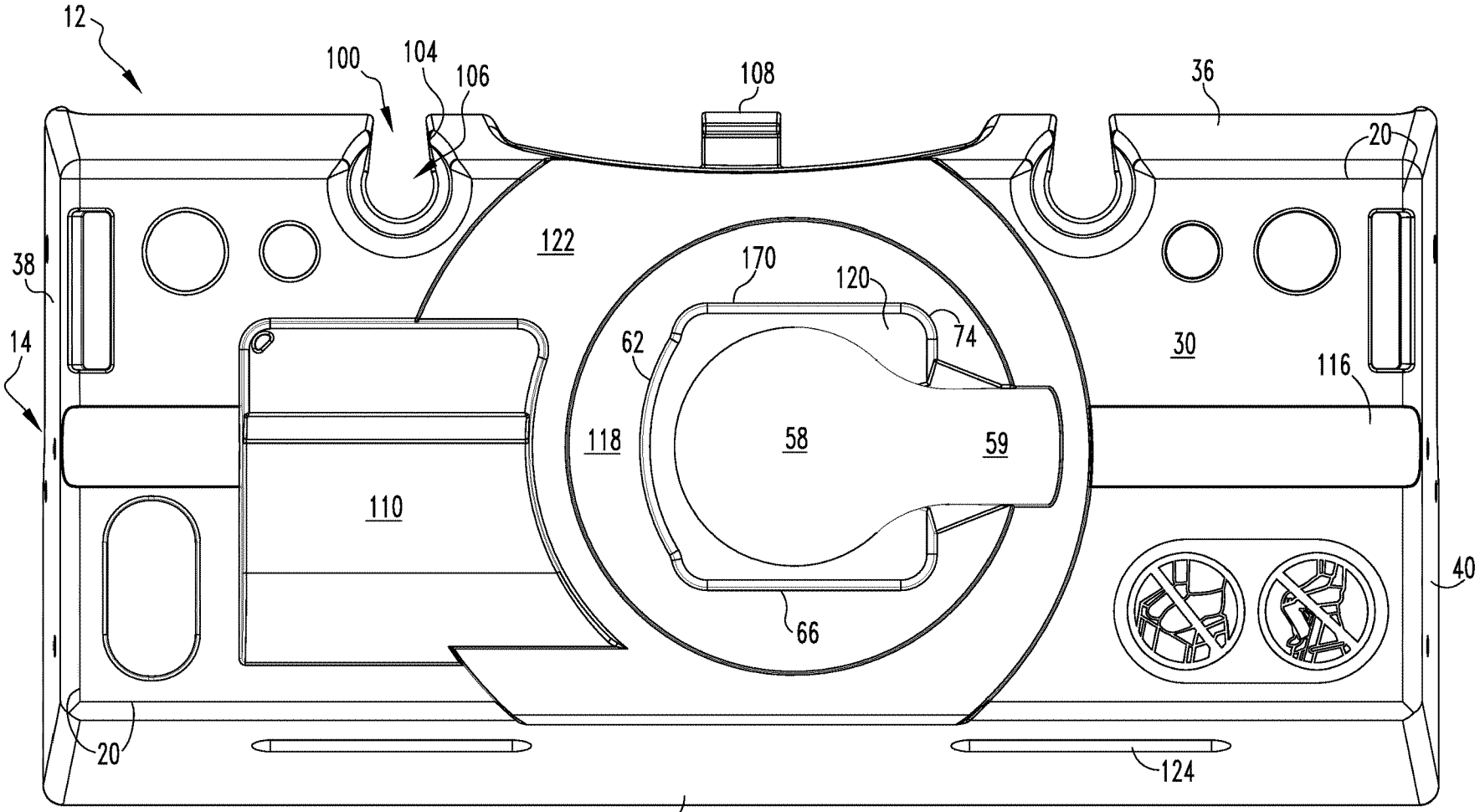
FIG. 6 is an overhead view of the ladder top.
Figure 7:
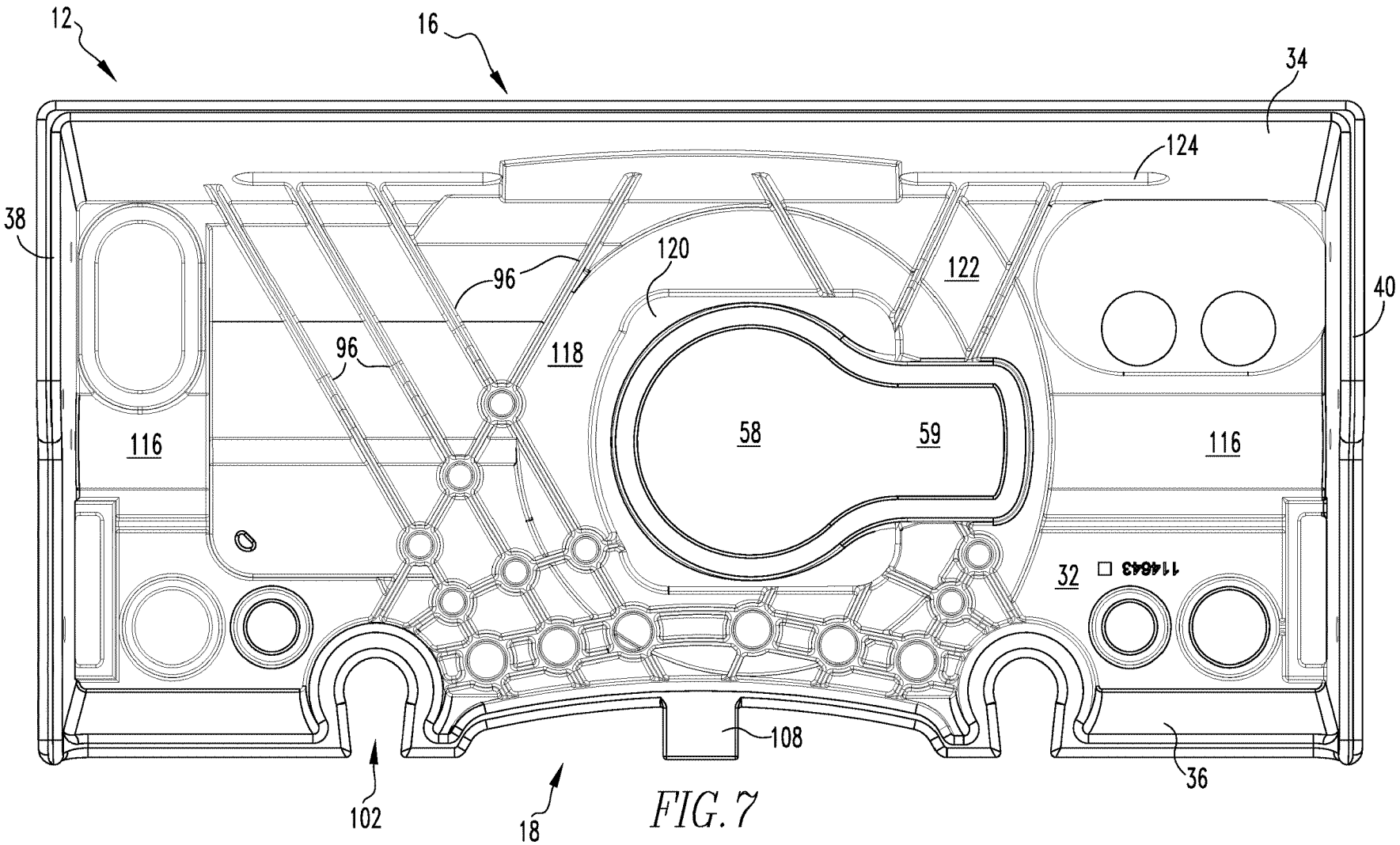
FIG. 7 is an underside view of the ladder top.
Figure 10:
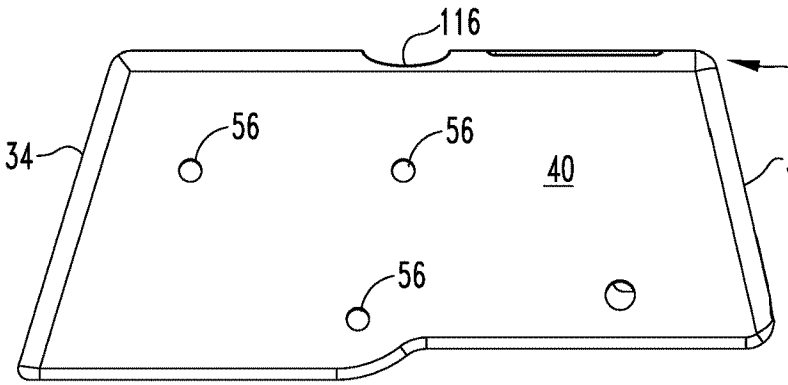
FIG. 10 is a side view of the ladder top.

Referring now to the drawings wherein like reference numerals refer to similar or identical parts throughout the several views, and more specifically to FIGS. 1-3 thereof, there is shown a ladder 10. The ladder 10 comprises a ladder top 12 having a plane 14 having a front 16 and a rear 18. The plane 14 having a periphery 20. The plane 14 having a body opening 20 to receive a body 22 of an impact driver 24 and a trigger recess 26 extending from the body opening 20 to receive a trigger 28 of the impact driver 24. The body opening 20 conforming to a shape of the body 22 and the trigger recess 26 conforming to the shape of the trigger 28. The body opening 20 and the trigger recess 26 holding the impact driver 24 when the impact driver 24 is placed on the top 12. The plane 14 has a top surface 30 and a bottom surface 32. The plane 14 has a front side flange 34, a rear side flange 36, a right side flange 38, and a left side flange 40, all of which extend down from the perimeter. The ladder 10 comprises a front section 42 having a first front rail 44 and a second front rail 46 in parallel and spaced relation with the first front rail 44. The first front rail 44 and the second front rail 46 extending from the top 12 and attached to the right side flange 38 and the left side flange 40, respectively. There may be rungs attached to the first front rail 44 and the second front rail 46. The ladder 10 comprises a rear section 48 having a first rear rail 50 and a second rear rail 52 in parallel in spaced relation with the first rear rail 50. The first rear rail 50 and the second rear rail 52 extending from the top 12 and attached to the right side flange 38 and the left side flange 40, respectively. The ladder top 12 and the front and rear sections 42, 48 form the ladder 10, otherwise called a stepladder. The rails may be attached to the top 12 with rivets 54 through rivet holes 56 in the side flanges to permanently affix the rails to the top 12, as shown in FIG. 3 and FIG. 10.

The body opening 20 may have a body hole 58 through which a front of the impact driver 24 extends when disposed in the body opening 20, as shown in FIGS. 4-7 and 14. The trigger recess 26 may have a trigger hole 59 extending from the body hole 58 in which the trigger 28 is disposed when the impact driver 24 is disposed in the body opening 20. The body hole 58 may be circularly shaped. The trigger hole 59 may be rectangularly shaped and coplanar with the body hole 58. The body opening 20 may have a bottom shelf 120 positioned about the body hole 58 and below the top surface 30 of the plane 14 on which the body 22 of the impact driver 24 is disposed when the impact driver 24 is disposed in the body opening 20, the body hole 58 disposed in the bottom shelf 120.

The body opening 20 may have a front face 62 and a front portion 64 which extends downward from the front face 62, a right face 66 that is connected to the front face 62 and has a right portion 68 which extends downward from the front face 62, a left face 70 that is connected to the front face 62 and a left portion 72 which extends downward from the left face 70 and is in spaced relation with the right face 66, and a rear face 74 connected to the right and left faces 66, 70 and has a rear portion 76 which extends downward from the rear face 74 and is in spaced relation with the front face 62. The trigger recess 26 extending from the rear face 74. The bottom shelf 120 extends inward from the front portion 64 and the right and left portions 68, 72 and the rear portion 76 and is flat. The trigger recess 26 may have a back first step wall 84 and a right first step wall 86 connected to the back first step wall 84 and a left first step wall 88 connected to the back first step wall 84 and in spaced relation with the right first step wall 86, all of which extend down. The body opening 20 may have a middle shelf 118 disposed below the top surface 30 and above the bottom shelf 120 on which a first diameter paint can can be disposed. The front face 62 and the left and right faces 70, 66 and the rear face 74 extending down from the middle shelf 118.

Figure 8:
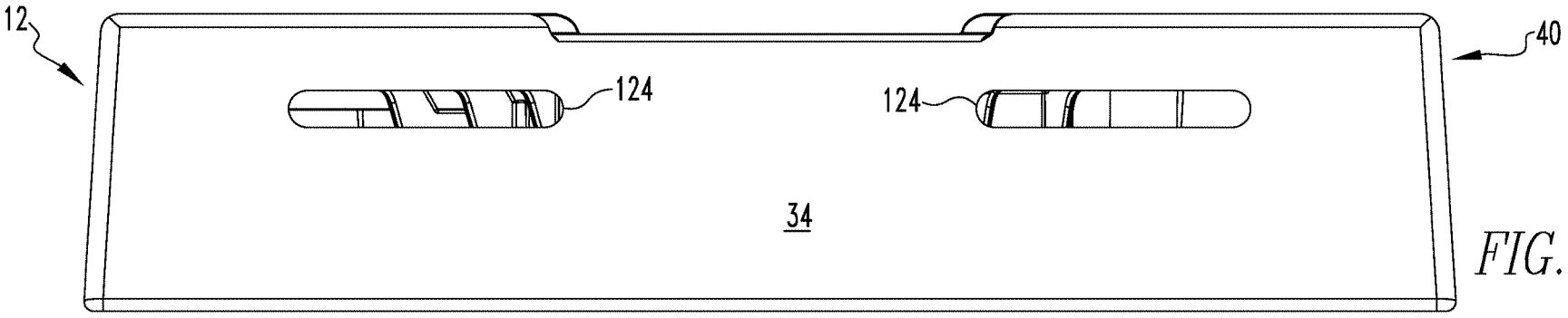
FIG. 8 is a front view of the ladder top.

The body opening 20 may have a top shelf 122 disposed below the top surface 30 and above the middle shelf 118 on which a second diameter paint can can be disposed. The second diameter is larger than the first diameter. The back first step wall 84 and the right and left first step walls 86, 88 extending down from the top shelf 122. The top shelf 122 and the middle shelf 118 both having a generally circular shaped periphery that conforms with the circular cross-sectional shape of a paint can. The top surface 30 and the right and left flanges 38, 40 may have a pipe holder slot 116 extending through them so a pipe or tube placed in the pipe holder slot 116 will be held in the pipe holder slot 116 and not roll back and forth in the slot. The pipe holder slot 116 on the right and left flanges 38, 40 is in the perimeter of the plane so the pipe or tube may be longer than the length of the ladder top 12 and extend beyond the length of the ladder top 12 but still be held in the pipe holder slot 116 since the pipe holder slot 116 is essentially continuous from the right flange to the left flange, even though there may be portions of the pipe holder slot 116 that are not present because the bin or the body opening 20 are instead where the pipe holder slot 116 would otherwise be if it extended as a single continuous slot. In the rear side, there may be tray slots 124 to receive tray brackets so a paint tray attached to the tray brackets may be securely but removeably held to the ladder top 12, as shown in FIG. 8.

Figure 11:
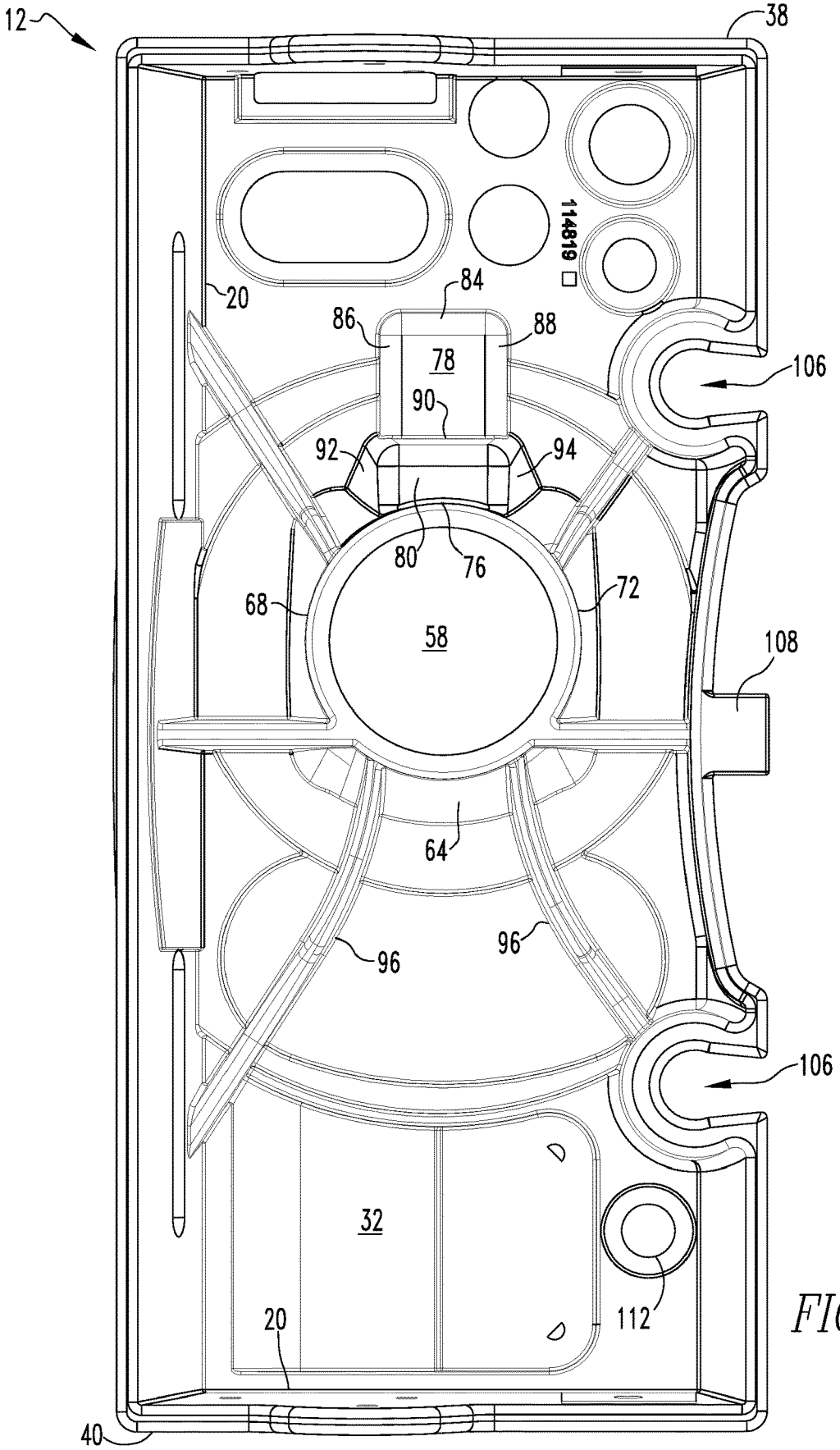
FIG. 11 is a bottom view of the ladder top in an alternative embodiment.
Figure 12:
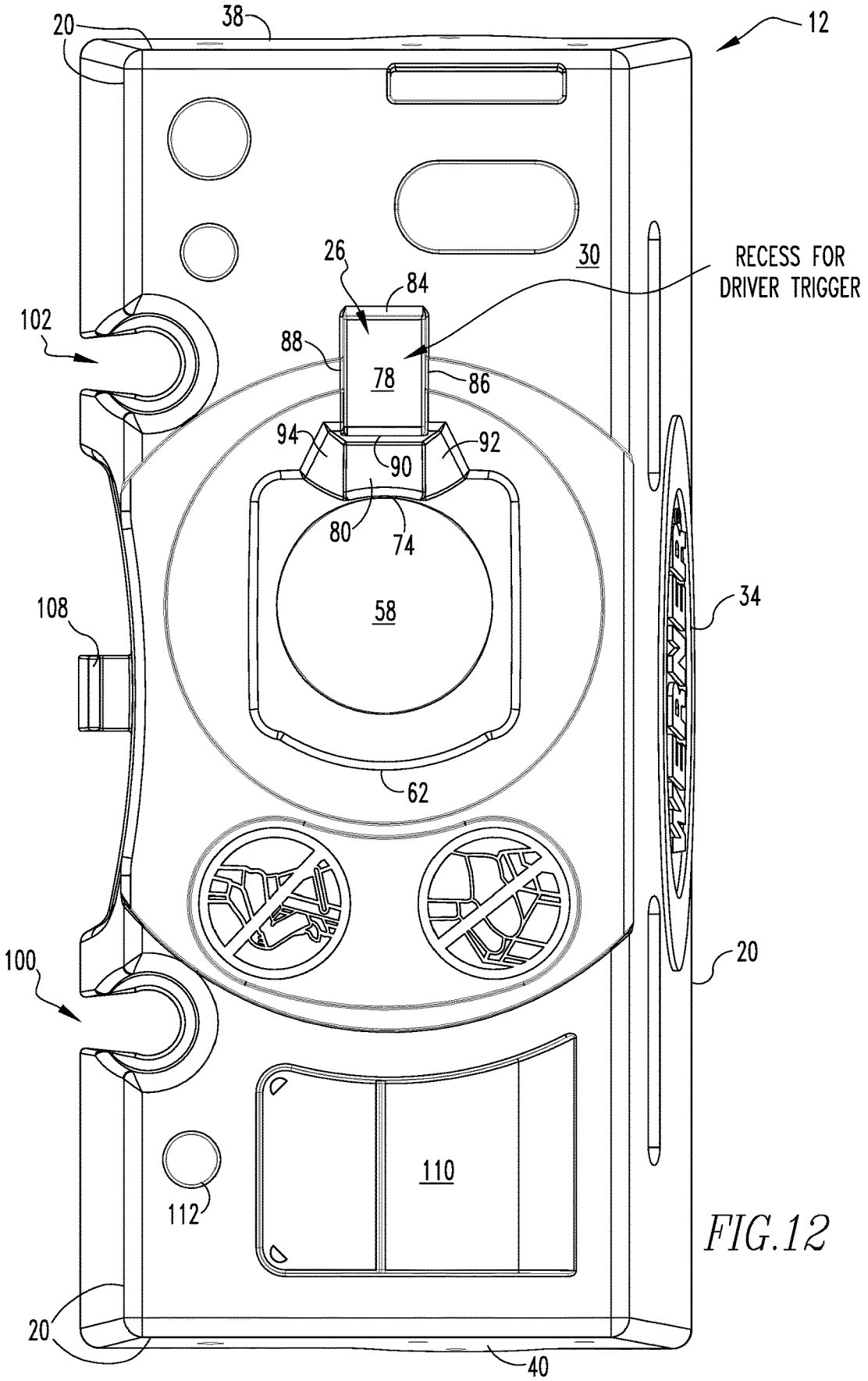
FIG. 12 is a top view of the ladder top in an alternative embodiment.

In an alternative embodiment, the body opening 20 may have a hole 58, as shown in FIGS. 11 and 12, through which a front of the impact driver 24 extends below the top 12 when the impact driver 24 is positioned in the body opening 20. The hole 58 extends through the plane 14 from the top surface 30 to the bottom surface 32. The body opening 20 may have a front face 62 that is curved and has a front portion 64 which tapers downward and inward from the surface, a right face 66 that is connected to the front face 62 and has a right portion 68 which tapers downward and inward from the surface, a left face 70 that is connected to the front face 62 and has a left portion 72 which tapers downward and inward from the surface and is in spaced relation with the right face 66, and a rear face 74 connected to the right and left faces 66, 70 and has a rear portion 76 which tapers downward and inward from the surface and is in spaced relation with the front face 62, the trigger recess 26 extending from the rear face 74.

The trigger recess 26 may have a first step 78 which extends down from the surface and a second step 80 which extends down from the surface and from the first step 78. The first step 78 and the second step 80 being rectangularly shaped. The second step 80 extending from the rear face 74. The front portion 64, right portion 68 and rear portion 76 may together form and have essentially a shape of a downward inward tapered cone ending at the hole 58. The second step 80 extending from the hole 58. The first and second steps 78, 80 and the front and right and left and rear portions 64, 68, 72, 76 together forming a continuous wall 82 having a shape which conforms with the trigger 28 and the body 22 of the impact driver 24. The hole 58 may have the shape of a circle. By having the impact driver 24 being held in the body opening 20 and trigger recess 26 approximately in the center of the ladder top 12, the impact driver 24 does not shift the center of gravity of the ladder 10 away from the center and towards the sides of the ladder 10 when the ladder 10 is in the in-use position. This contributes to a safer use of the ladder 10 since by having the center of gravity of the ladder 10 staying essentially in the center of the ladder 10, as opposed to shifting towards one side or the other of the ladder 10, the presence of the impact driver 24 does not increase the likelihood the ladder 10 will tip over because the presence of the impact driver 24 on the ladder top 12 has not shifted the center of gravity forward to one side or the other of the ladder 10. Positioning the impact driver 24 in approximately the center of the ladder top 12, it securely keeps the impact driver 24 in place and prevents it from easily being pushed off the ladder top 12. Furthermore, it provides for added convenience and lower incidence of dropped objects from the ladder 10.

The first step 78 may have a back first step wall 84 and a right first step wall 86 connected to the back first step wall 84 and a left first step wall 88 connected to the back first step wall 84 and in spaced relation with the right first wall, all of which extend down from the surface. The second step 80 may have a back second step wall 90 and a right second step wall 92 connected to the back second step wall 90 and a left second step wall 94 connected to the back second step wall 90 and in spaced relation with the right second wall. The back second step wall 90 extending down from the first step 78 and the right second step wall 92 and the left second step wall 94 extending down from the surface.

Figure 9:
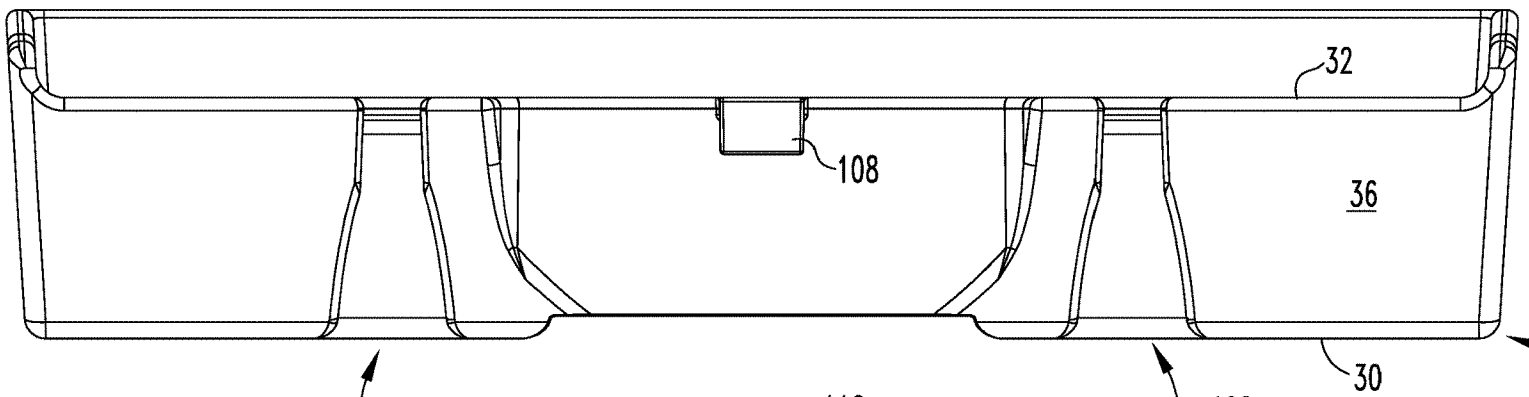
FIG. 9 is a rear view of the ladder top.
Figure 13:
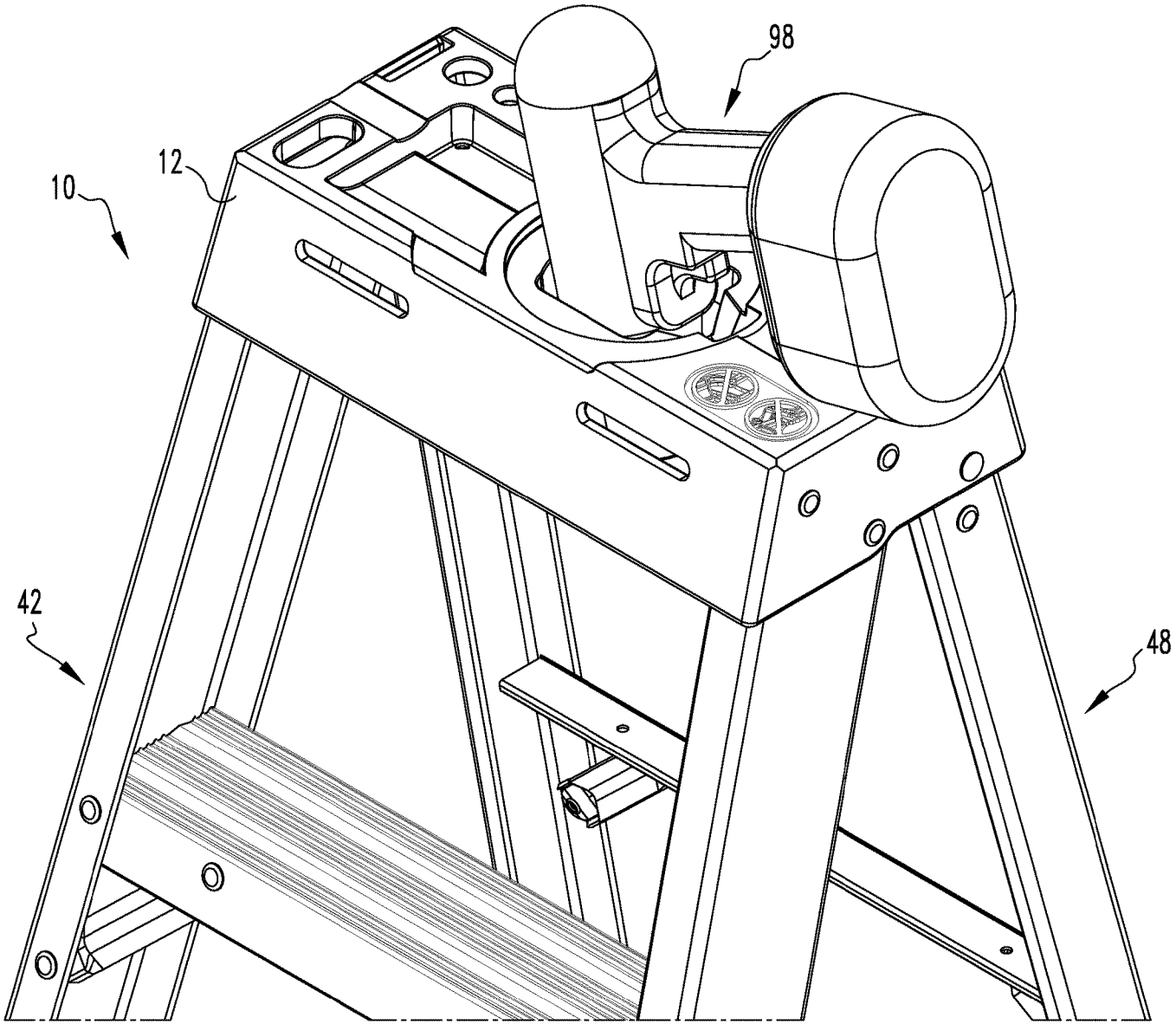
FIG. 13 is a perspective view of the top of the ladder holding a drill.
Figure 14:
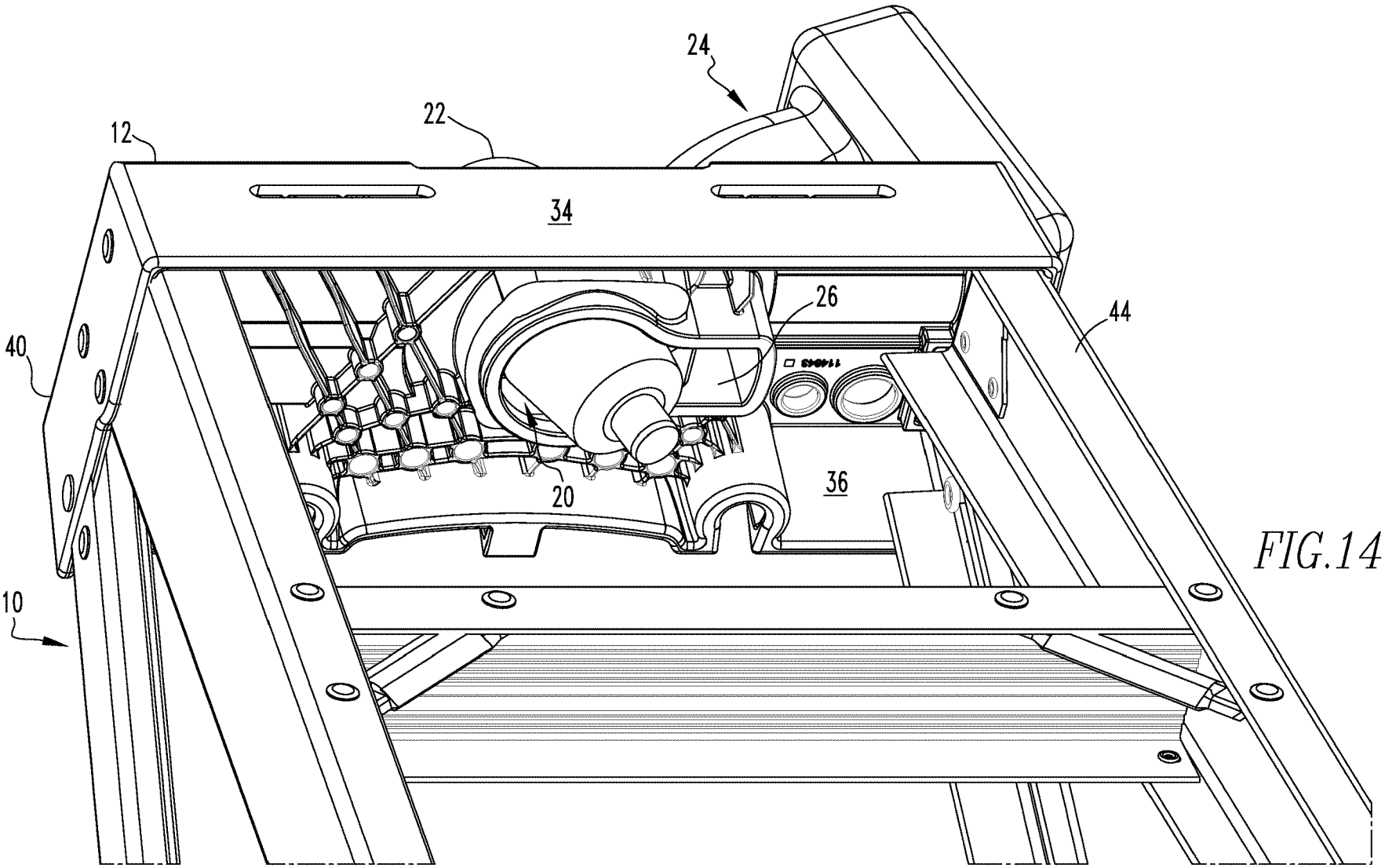
FIG. 14 is an underside perspective view of the ladder top with an impact driver.

The ladder 10 may include buttressing 96, as shown in FIG. 11, extending down from the surface and from the front 16 and rear sides. The body opening 20 may be configured to hold a drill 98, as shown in FIG. 13. The rear side may have a first bungee tool holding slot 100 having a first bungee opening 104 in the periphery 20 to hold a ball and bungee strap unit. The first bungee opening 104 of the slot extends through the ladder top 12 in the periphery 20 from the top surface 30 to the bottom surface 32, as shown in FIG. 9. The first bungee tool holding slot 100 has a circular region 106 that extends into the plane 14 from the opening, the slot is wider at the top than the bottom.

The ladder 10 may include a hook 108 extending from the rear side from which objects can be hanged, as shown in FIG. 9. The plane 14 may have a bin 110. The plane 14 may have at least one screwdriver hole 112 for holding a screwdriver. The plane 14 may have a second bungee tool holding slot 102 disposed at the rear 18 of the plane 14 in the rear side.

The present invention pertains to a method for using an impact driver 24 with a ladder 10. The method comprises the steps of positioning the ladder 10 in a desired position. There is the step of placing the impact driver 24 into a top 12 of the ladder 10. The top 12 having a plane 14 having a front 16 and a rear 18. The plane 14 having a periphery 20. The plane 14 having a body opening 20 to receive a body 22 of an impact driver 24 and a trigger recess 26 extending from the body opening 20 to receive a trigger 28 of the impact driver 24. The body opening 20 conforming to a shape of the body 22 and the trigger recess 26 conforming to the shape of the trigger 28. The body opening 20 and the trigger recess 26 holding the impact driver 24 when the impact driver 24 is placed on the top 12. The plane 14 has a top surface 30 and a bottom surface 32. The plane 14 has a front side flange 34, a rear side flange 36, a right side flange 38, and a left side flange 40, all of which extend down from the perimeter.

The present invention pertains to a top 12 for a ladder 10, as shown in FIGS. 4-7. The top 12 comprises a plane 14 having a front 16 and a rear 18. The plane 14 having a periphery 20. The plane 14 having a body opening 20 to receive a body 22 of an impact driver 24 and a trigger recess 26 extending from the body opening 20 to receive a trigger 28 of the impact driver 24. The body opening 20 conforming to a shape of the body 22 and the trigger recess 26 conforming to the shape of the trigger 28. The body opening 20 and the trigger recess 26 holding the impact driver 24 when the impact driver 24 is placed on the top 12. The plane 14 has a top surface 30 and a bottom surface 32. The plane 14 has a front side flange 34, a rear side flange 36, a right side flange 38, and a left side flange 40, all of which extend down from the perimeter.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A ladder comprising:

a ladder top having a plane having a front and a rear, the plane having a perimeter, the plane having a body opening to receive a body of an impact driver and a trigger recess extending from the body opening to receive a trigger of the impact driver, the body opening configured to receive the body and trigger, the body opening and the trigger recess being configured for holding the impact driver, the plane has a top surface and a bottom surface, the plane has a front side flange, a rear side flange, a right side flange, and a left side flange, all of which extend down from the perimeter, the body opening configured for a front of the impact driver to extend below the top surface, the body opening extends through the plane from the top surface to the bottom surface, the body opening is circularly shaped, the trigger recess rectangularly shaped and coplanar with the body opening, the body opening has a bottom shelf positioned within the body opening and below the top surface of the plane, the body opening extends through the bottom shelf, the body opening has a front face and a front portion which extends downward from the front face, a right face that is connected to the front face and has a right portion which extends downward from the right face, a left face that is connected to the front face and has a left portion which extends downward from the left face and is in spaced relation with the right face, and a rear face connected to the right and left faces and has a rear portion which extends downward from the rear face and is in spaced relation with the front face, the trigger recess extending from the rear face, the bottom shelf extends inward from the front portion and the right and left portions and the rear portion and is flat;

a front section having a first front rail and a second front rail in parallel and spaced relation with the first front rail, the first front rail and the second front rail extending from the ladder top and attached to the right side flange and the left side flange, respectively; and a rear section having a first rear rail and a second rear rail in parallel and spaced relation with the first rear rail, the first rear rail and the second rear rail extending from the ladder top and attached to the right side flange and the left side flange, respectively, wherein said ladder top and the front and rear sections form the ladder.

2. The ladder of claim 1 wherein the trigger recess has a back first step wall and a right first step wall connected to the back first step wall and a left first step wall connected to the back first step wall and in spaced relation with the right first step wall, all of which extend down.

3. The ladder of claim 2 wherein the body opening has, a middle shelf disposed below the top surface and above the bottom shelf on which a first diameter paint can can be disposed, the first face and the left and right faces and the rear face extending down from the middle shelf.

4. The ladder of claim 3 wherein the body opening has a top shelf disposed below the top surface and, above the middle shelf on which a second diameter paint can can be disposed, the second diameter larger than the first diameter, the back first step wall and the right and left first step walls extending down from the top shelf.

5. The ladder of claim 4 wherein the top surface and the right and left flanges have a pipe holder slot extending through them.

6. A top for a ladder comprising:

a plane having a front and a rear, the plane having a perimeter, the plane having a body opening to receive a body of an impact driver and a trigger recess extending from the body opening to receive a trigger of the impact driver, the body opening configured to reCeive the body and trigger, the plane has a top surface and a bottom surface, the plane has a front side flange, a rear side flange, a right side flange, and a left side flange, all of which extend down from the perimeter, the body opening configured for a front of the impact driver to extend below the top surface, the body opening extends through the plane from the top surface to the bottom surface, the body opening is circularly shaped, the trigger recess rectangularly shaped and coplanar with the body opening, the body opening has a bottom shelf positioned within the body opening and below the top surface of the plane, the body opening extends through the bottom shelf, the body opening has a front face and a front portion which extends downward from the front face, a right face that is connected to the front face and has a right portion which extends downward from the right face, a left face that is connected to the face and has a left portion which extends downward from the left face and is in spaced relation with the right face, and a rear face connected to the right and left faces and has a rear portion which extends downward from the rear face and is in spaced elation with the front face, the trigger recess extending from the rear face, the bottom shelf extends inward from the front portion and the right and left portions and the rear portion and is flat.

* * * * *